US006276904B1

(12) United States Patent
Ota et al.

(10) Patent No.: US 6,276,904 B1
(45) Date of Patent: Aug. 21, 2001

(54) VARIABLE CAPACITY REFRIGERANT COMPRESSOR HAVING AN INCLINATION LIMITING MEANS TO INTERRUPT COMPRESSIVE FORCES ON A HINGE MECHANISM

(75) Inventors: Masaki Ota; Hajime Kurita; Kenta Nishimura; Hirotaka Kurakake, all of Aichi-ken (JP)

(73) Assignee: Toyoda Automatic Loom Works, Ltd., Kariya (JP)

( * ) Notice: Subject to any disclaimer, the term of this patent is extended or adjusted under 35 U.S.C. 154(b) by 0 days.

(21) Appl. No.: 09/271,843

(22) Filed: Mar. 18, 1999

(30) Foreign Application Priority Data

Mar. 18, 1998 (JP) ..... 10-068475

(51) Int. Cl.[7] ..... F04B 1/26
(52) U.S. Cl. ..... 417/222.2; 417/269; 91/505
(58) Field of Search ..... 417/222.2, 269; 91/505; 92/12.2

(56) References Cited

U.S. PATENT DOCUMENTS 5,293,810 * 3/1994 Kimura et al. ..... 92/12.2
5,387,091 * 2/1995 Kawaguchi et al. ..... 417/222.2
5,540,559 * 7/1996 Kimura et al. ..... 417/222.2
5,556,261 9/1996 Kimura et al. ..... 417/269
5,722,310 * 3/1998 Ota et al. ..... 417/222.2
6,077,047 * 6/2000 Nagai et al. ..... 417/222.1

FOREIGN PATENT DOCUMENTS 4-164167 A * 6/1992 (JP) ..... 417/222.2
5-312147 A 11/1993 (JP) .

* cited by examiner

*Primary Examiner*—Cheryl J. Tyler
(74) *Attorney, Agent, or Firm*—Woodcock Washburn Kurtz Mackiewicz & Norris LLP

(57) ABSTRACT

A maximum inclination setting projection comes into contact with a rotary support in a region closer to a point corresponding to a top dead center than an imaginary two-part dividing plane, thereby establishing a maximum angle of inclination of a cam plate. Thus, a hinge mechanism is not required to support any proportion of a compressive load in the region closer to the point corresponding to the top dead center than the imaginary two-part dividing plane when the cam plate is in its maximum angle of inclination. Bulbous parts of guide pins do not come in contact with halves of cylindrical inside surfaces of guide holes closer to the rotary support, and there is made a clearance between the bulbous part of the guide pin and the guide hole and between the bulbous part of the guide pin and the guide hole, interrupting transmission of the compressive load between them.

32 Claims, 6 Drawing Sheets

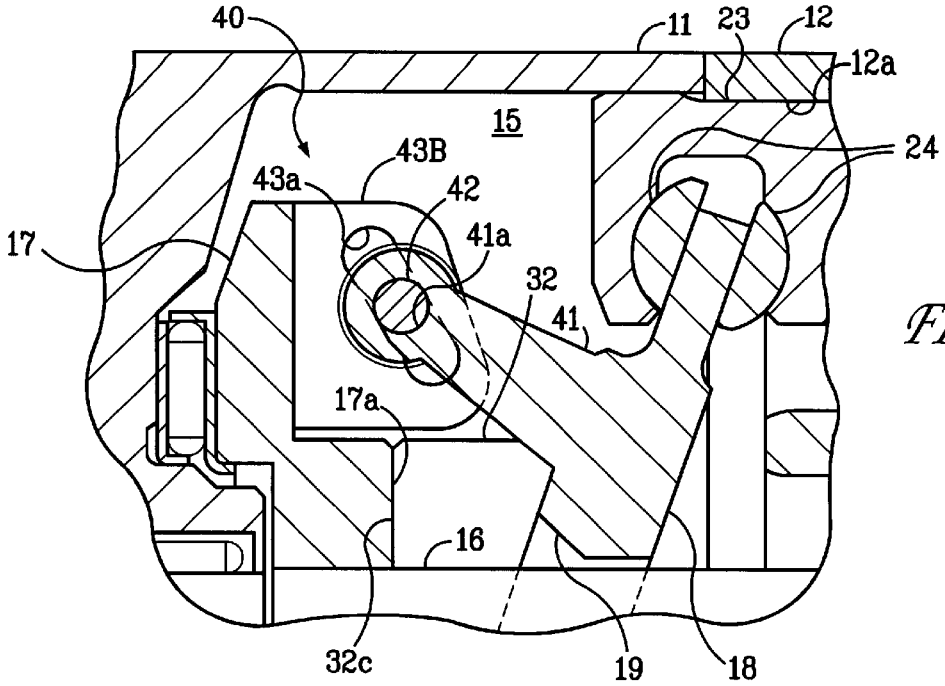
FIG. 6
FIG. 7
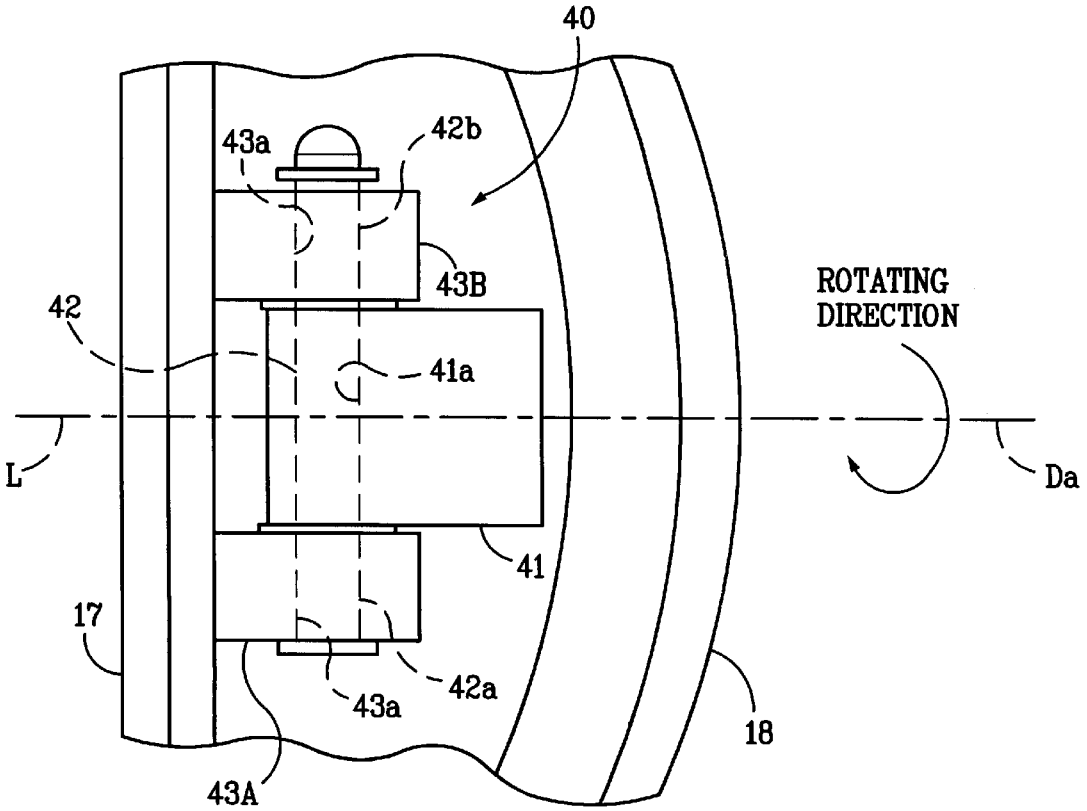

VARIABLE CAPACITY REFRIGERANT COMPRESSOR HAVING AN INCLINATION LIMITING MEANS TO INTERRUPT COMPRESSIVE FORCES ON A HINGE MECHANISM

BACKGROUND OF THE INVENTION

1. Field of the Invention

The present invention relates to variable displacement compressors which are employed in motor vehicle air-conditioning systems, for instance.

2. Description of the Related Art

FIG. 10 shows a conventionally known structure employed in a variable displacement compressor of this kind, in which cylinder bores 101*a* are formed in a housing 101, a drive shaft 102 is rotatably supported in the housing 101, a rotary support 103 is fixed to the drive shaft 102, a cam plate 104 is supported by the drive shaft 102 which is passed through a through hole 104*a* formed in the cam plate 104, and pistons 105 fitted in the individual cylinder bores 101*a* are joined to the cam plate 104. A maximum inclination setting projection 106 protrudes from about a point Db of the cam plate 104 corresponding to a bottom dead center toward the rotary support 103.

A hinge mechanism 107 comprises guide pins 108 provided close to a point Da of the cam plate 104 corresponding to a top dead center and supporting arms 109 provided on the rotary support 103 corresponding to the guide pins 108. The guide pins 108 are firmly press-fitted into holes formed in the cam plate 104 and have bulbous parts 108*a* at extreme ends. On the other hand, guide holes 109*a* are formed in the individual supporting arms 109. The guide pins 108 and the supporting arms 109 are joined together as the bulbous parts 108*a* of the former are fitted into the respective guide holes 109*a* of the latter.

With the bulbous parts 108*a* of the guide pins 108 fitted into the guide holes 109*a* in the individual supporting arms 109, the cam plate 104 can rotate together with the drive shaft 102. Thus, rotary motion of the drive shaft 102 is converted into reciprocating motion of the pistons 105 in the cylinder bores 101*a* by way of the rotary supports 103, the hinge mechanism 107 and the cam plate 104. As a consequence, a refrigerant gas is introduced into the cylinder bores 101*a*, compressed, and discharged in repeated cycles.

The drive shaft 102 supports the cam plate 104 in such a way that the cam plate 104 can vary its angle of inclination while sliding along the drive shaft 102. This is because the bulbous parts 108*a* of the individual guide pins 108 and the guide holes 109*a* of the hinge mechanism 107 work as slide guides and the through hole 104*a* allows the cam plate 104 to slide along the drive shaft 102. The stroke of the pistons 105 and, thus, the displacement capacity of the compressor are varied by adjusting the angle of inclination of the cam plate 104. When the maximum inclination setting projection 106 of the cam plate 104 comes into contact with the rotary support 103, the cam plate 104 is restrained from sliding and inclining further, where the cam plate 104 reaches its maximum angle of inclination.

When the cam plate 104 is set to its maximum angle of inclination, the stroke of the pistons 105 increases so that the refrigerant gas compression ratio also increases. As a result, a large compressive load acts on the supporting arms 109 by way of the pistons 105, the cam plate 104 and the guide pins 108 so that the guide pins 108 receive a high level of reaction force from the supporting arms 109 which sustain the compressive load. The guide pins 108 employed in the conventional structure have a large diameter, for instance, so that they should be able to withstand the large reaction force. Furthermore, portions of the cam plate 104 where the guide pins 108 are fitted are made thicker to provide a sufficient mechanical strength for supporting the guide pins 108.

The use of the large-diameter guide pins 108, which have naturally a heavy weight, combined with the thickening of the portions around the holes in which the guide pins 108 are fitted results in a considerable increase in the weight of the cam plate 104. In addition, there is the need to fit a large counterweight to make up for an unbalanced weight distribution around an axis L of the drive shaft 102 caused by the provision of the guide pins 108 and the thickened portions of the cam plate 104. This also causes an increase in the weight of the cam plate 104. A major problem resulting from such increase in the weight of the cam plate 104 in the conventional structure has been the delay in altering the angle of inclination of the cam plate 104, or deterioration of the controllability of the displacement capacity of the compressor.

According to a proposal made in recent years, the weight of the compressor can be reduced by forming the cam plate 104 with an aluminum-based metallic material. The cam plate 104 formed of the aluminum-based metallic material has a lower stiffness than conventionally used iron-based metallic materials, however. It has therefore been difficult to produce the guide pins 108 with a desired length of fit which would be required for securely press-fitting the guide pins 108 into the cam plate 104 and, as a consequence, the guide pins 108 have tended to be mounted with low strength. Accordingly, what is important for producing the cam plate 104 with the aluminum-based metallic material is to lower the ratio of a load supported by the hinge mechanism 107 to a maximum compressive load acting on the cam plate 104 when the compressor is operated at its maximum displacement capacity.

SUMMARY OF THE INVENTION

The present invention has been made in the light of the aforementioned problems of prior art technology. Accordingly, it is an object of the invention to provide variable displacement compressors which makes it possible to lower the proportion of load supported by a hinge mechanism to a maximum compressive load exerted on a cam plate when the compressor is operated at its maximum displacement capacity and to reduce the weight of the cam plate.

According to a principal aspect of the invention, a variable displacement compressor comprises a hinge mechanism including a guiding projection provided on a cam plate or a rotary support at about a point corresponding to a top dead center of the cam plate and a guide provided on the cam plate or the rotary support on which the guiding projection is not provided, the guiding projection being slidably fitted in the guide, wherein a maximum inclination setting part formed on the cam plate comes into contact with the rotary support at least in a region closer to the point corresponding to the top dead center than an imaginary two-part dividing plane which intersects an imaginary plane including the point corresponding to the top dead center and an axis of a drive shaft and imaginarily divides the cam plate into two parts, and there is made a clearance between the guiding projection and the guide so that transmission of a compressive load between them is interrupted when the cam plate is in its maximum angle of inclination and supported by its maximum inclination setting part which has come into contact with the rotary support.

In this construction, the cam plate is supported at least in the region closer to the point corresponding to the top dead center than the imaginary two-part dividing plane as the maximum inclination setting part comes into contact with the rotary support when the cam plate is in its maximum angle of inclination. Thus, the hinge mechanism is not required to support any proportion of the compressive load in the region closer to the point corresponding to the top dead center than the imaginary two-part dividing plane. It has therefore been possible to construct the hinge mechanism in such a way that a clearance is created between the guiding projection and the guide so that transmission of the compressive load between them is interrupted.

According to another aspect of the invention, there are provided one pair each of guiding projections and guides, one each guiding projection and guide being located on both sides of the point corresponding to the top dead center of the cam plate, wherein the maximum inclination setting part comes into contact with the rotary support ahead of the point corresponding to the top dead center with respect to the rotating direction of the drive shaft in the region closer to the point corresponding to the top dead center than the imaginary two-part dividing plane, and there is made a clearance between the guiding projection and the guide which are located ahead of the point corresponding to the top dead center with respect to the rotating direction of the drive shaft so that transmission of the compressive load between them is interrupted when the cam plate is in its maximum angle of inclination and supported by its maximum inclination setting part which has come into contact with the rotary support.

In this construction, the cam plate is supported ahead of the point corresponding to the top dead center with respect to the rotating direction of the drive shaft at least in the region closer to the point corresponding to the top dead center than the imaginary two-part dividing plane as the maximum inclination setting part comes into contact with the rotary support when the cam plate is in its maximum angle of inclination. Thus, an area of contact between the guiding projection and the guide which are located ahead of the point corresponding to the top dead center with respect to the rotating direction of the drive shaft is not required to support any proportion of the compressive load ahead of the point corresponding to the top dead center with respect to the rotating direction of the drive shaft in the region closer to the point corresponding to the top dead center than the imaginary two-part dividing plane. It has therefore been possible to construct the hinge mechanism in such a way that a clearance is created between the guiding projection and the guide which are located ahead of the point corresponding to the top dead center with respect to the rotating direction of the drive shaft so that transmission of the compressive load between them is interrupted.

According to still another aspect of the invention, there are provided one pair each of guiding projections and guides, one each guiding projection and guide being located on both sides of the point corresponding to the top dead center of the cam plate, wherein the maximum inclination setting part comes into contact with the rotary support behind the point corresponding to the top dead center with respect to the rotating direction of the drive shaft in the region closer to the point corresponding to the top dead center than the imaginary two-part dividing plane, and there is made a clearance between the guiding projection and the guide which are located behind the point corresponding to the top dead center with respect to the rotating direction of the drive shaft so that transmission of the compressive load between them is interrupted when the cam plate is in its maximum angle of inclination and supported by its maximum inclination setting part which has come into contact with the rotary support.

In this construction, the cam plate is supported behind the point corresponding to the top dead center with respect to the rotating direction of the drive shaft at least in the region closer to the point corresponding to the top dead center than the imaginary two-part dividing plane as the maximum inclination setting part comes into contact with the rotary support when the cam plate is in its maximum angle of inclination. Thus, an area of contact between the guiding projection and the guide which are located behind the point corresponding to the top dead center with respect to the rotating direction of the drive shaft is not required to support any proportion of the compressive load behind the point corresponding to the top dead center with respect to the rotating direction of the drive shaft in the region closer to the point corresponding to the top dead center than the imaginary two-part dividing plane. It has therefore been possible to construct the hinge mechanism in such a way that a clearance is created between the guiding projection and the guide which are located behind the point corresponding to the top dead center with respect to the rotating direction of the drive shaft so that transmission of the compressive load between them is interrupted.

According to the aforementioned constructions of the invention, it is possible to lower the proportion of load supported by the hinge mechanism to the maximum compressive load exerted on the cam plate when the cam plate is in its maximum angle of inclination. Accordingly, it is not necessary to take into account a large reaction force to the maximum compressive load in designing the guiding projections and, as a consequence, it becomes possible to avoid an increase in the weight of the cam plate unlike the earlier-described prior art technology. This makes it possible to swiftly alter the angle of inclination of the cam plate, enabling an improvement in the controllability of the displacement capacity of the compressor.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings exemplary embodiments that are presently preferred, it being understood, however, that the invention is not limited to the specific methods and instrumentalities disclosed. In the drawings:

FIG. 6 is a diagram showing a hinge mechanism according to a second exemplary embodiment of the invention;

FIG. 7 is a plan view showing a hinge mechanism of the second embodiment and its surrounding structure;

DETAILED DESCRIPTION OF THE PREFERRED EMBODIMENTS

The invention will now be described in combination with first and second embodiments thereof as implemented in a single-ended piston type variable displacement compressor, in which the description of the second embodiment will focus primarily on its differences from the first embodiment.

FIRST EMBODIMENT

Figure 1:
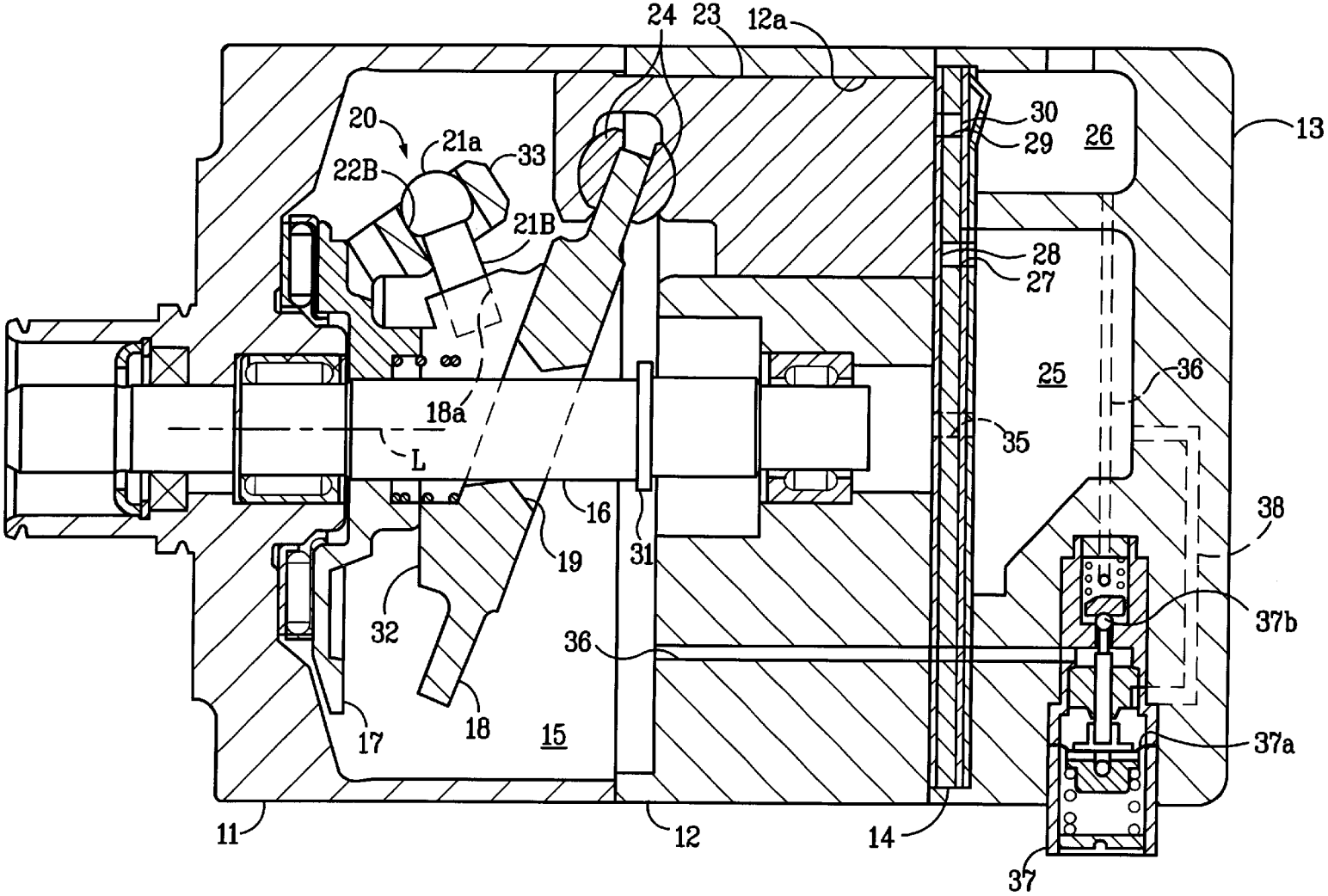
FIG. 1 is a longitudinal cross-sectional view of a variable displacement compressor according to a first exemplary embodiment of the invention.

As shown in FIG. 1, a front housing 11 is firmly joined to a front end of a cylinder block 12 which serves as a center housing. A rear housing 13 is firmly joined to the a rear end of the cylinder block 12 with a valve plate 14 placed in between. A crankcase 15 is formed in a space enclosed by the front housing 11 and the cylinder block 12. Spanning through the crankcase 15, a drive shaft 16 is rotatably supported by the front housing 11 and the cylinder block 12. The drive shaft 16 is linked to a vehicle engine (not shown) serving as an external source of motive power via a clutch mechanism like an electromagnetic clutch. In this construction, the drive shaft 16 is caused to rotate when the electromagnetic clutch is engaged while the vehicle engine is running.

A rotary support 17 is firmly attached to the drive shaft 16 inside the crankcase 15. A cam plate 18 is preferably formed of an aluminum-based metallic material, such as an aluminum alloy, and accommodated in the crankcase 15. The drive shaft 16 is fitted in a through hole 19 formed in a central part of the cam plate 18, and a hinge mechanism 20 is provided between the rotary support 17 and the cam plate 18.

Figure 2:
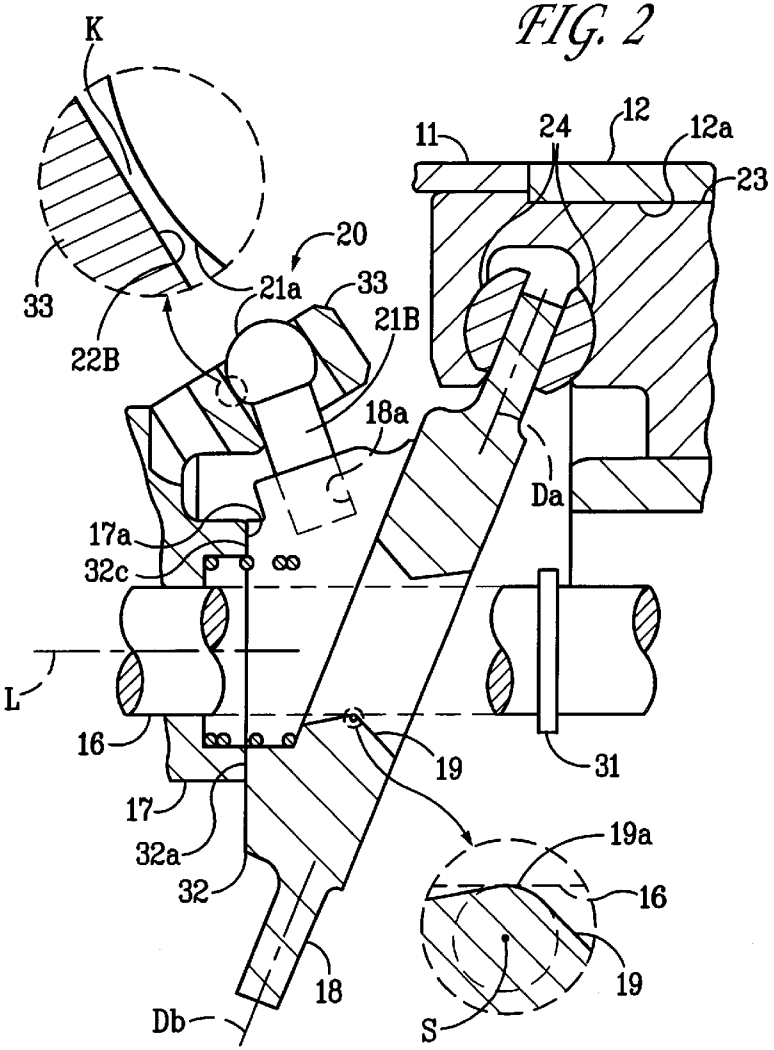
FIG. 2 is an enlarged fragmentary diagram of the variable displacement compressor of FIG. 1.

As shown in FIG. 2, an axis S extends in a direction perpendicular to an axis L of the drive shaft 16 and is located opposite to the hinge mechanism 20 with respect to the axis L of the drive shaft 16 so that the axis S lies beyond the drive shaft 16 as viewed from the hinge mechanism 20. A supporting part 19*a* formed in the through hole 19 has an arc-shaped cross section centered on the axis S and is located opposite to the hinge mechanism 20 with respect to the axis L of the drive shaft 16.

Figure 4:
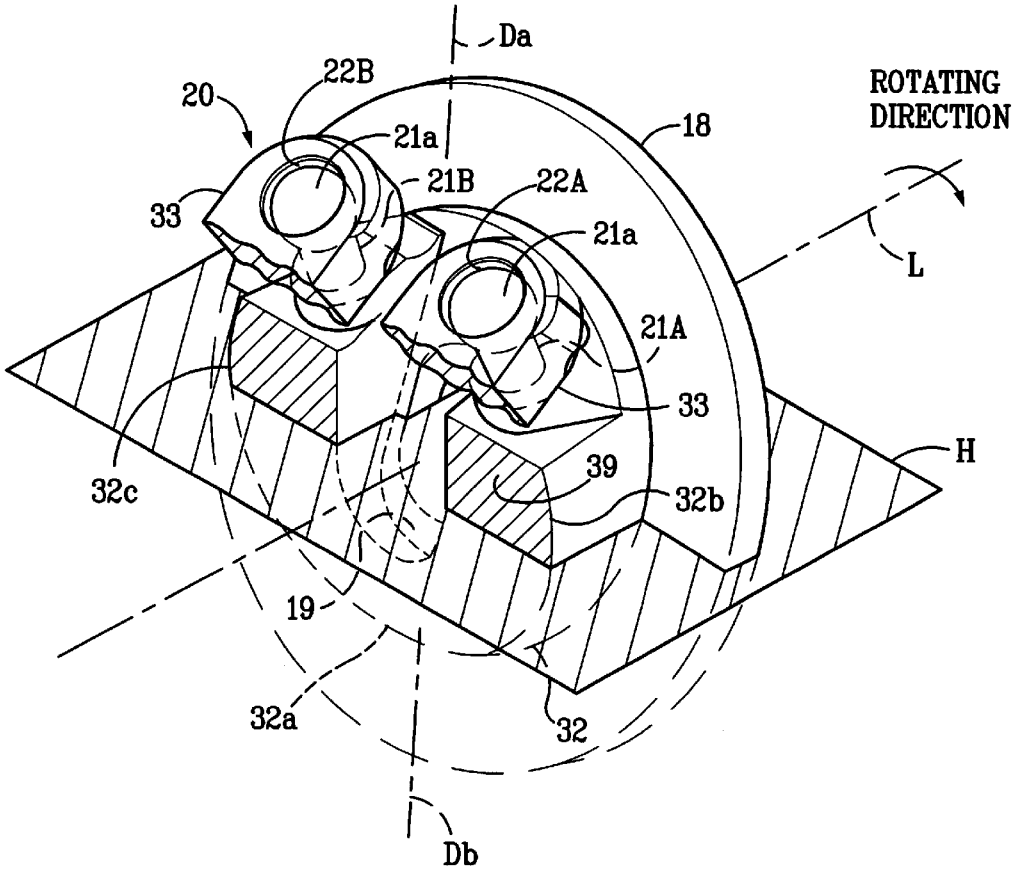
FIG. 4 is a perspective view of the cam plate.

The aforementioned hinge mechanism 20 is now described in greater detail. As shown in FIGS. 2 and 4, a pair of mounting holes 18*a* are formed in an outer frontal part of the cam plate 18, symmetrically about a point Da of the cam plate 18 corresponding to a top dead center. Guide pins 21A and 21B which serve as guiding projections are securely press-fitted into the mounting holes 18*a* in the cam plate 18. Thus, the guide pins 21A and 21B are located on both sides of the point Da corresponding to the top dead center, one ahead of and the other behind the point Da with respect to the rotating direction of the drive shaft 16. There are formed bulbous parts 21*a* at extreme ends of the guide pins 21A and 21B.

There are provided a pair of supporting arms 33 on the rotary support 17 projecting from its rear surface symmetrically on both sides of the point Da of the cam plate 18 corresponding to the top dead center. Guide holes 22A and 22B having a generally cylindrical shape, which serve as guides, are formed in terminal portions of the individual supporting arms 33. The guide holes 22A and 22B extend from outside toward the axis L of the drive shaft 16. The guide pins 21A and 21B are connected to the supporting arms 33 as the bulbous parts 21 a of the former are fitted into the guide holes 22A and 22B of the latter, respectively.

Figure 3:
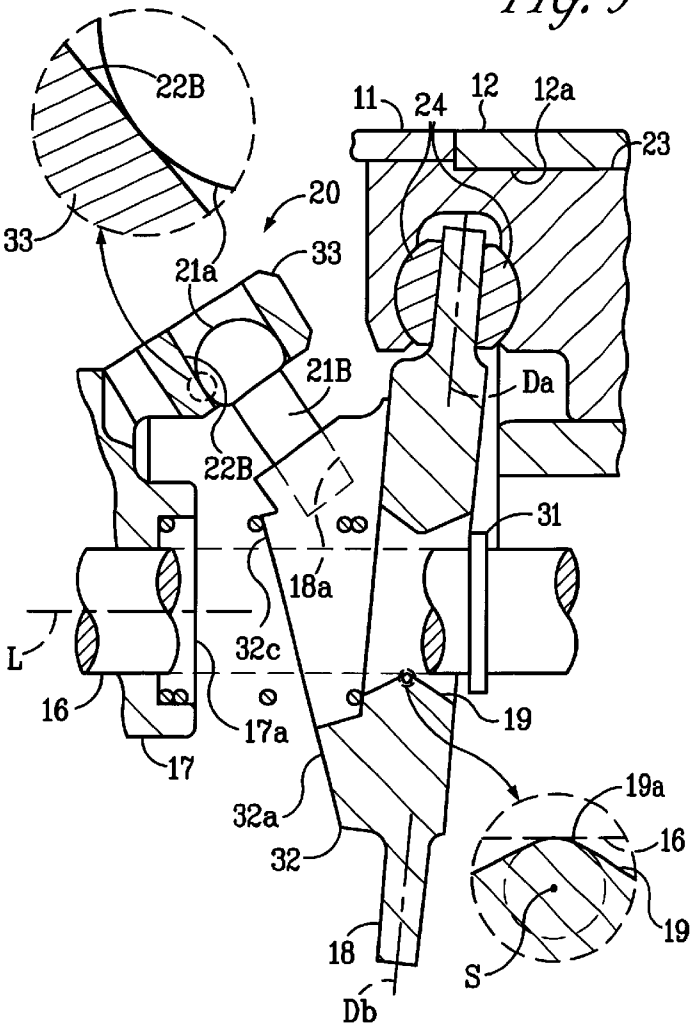
FIG. 3 is a diagram showing a state in which a cam plate is set to its minimum angle of inclination.

The drive shaft 16 supports the cam plate 18 in such a way that the cam plate 18 can slide along the axis L of the drive shaft 16 while varying its angle of inclination. This is because the bulbous parts 21*a* of the guide pins 21A and 21B and the guide holes 22A and 22B of the supporting arms 33 work as slide guides and the through hole 19 allows the cam plate 18 to slide along the drive shaft 16. As shown in FIG. 3, the angle of inclination of the cam plate 18 decreases when its central part slides toward the cylinder block 12. As the cam plate 18 comes into contact with a snap ring 31 which is securely fitted on the drive shaft 16 between the cam plate 18 and the cylinder block 12, the snap ring 31 restricts the angle of inclination of the cam plate 18.

As can be seen from FIG. 2, the angle of inclination of the cam plate 18 increases when its central part slides toward the rotary support 17. There is formed a maximum inclination setting part 32 on a front surface of the cam plate 18, projecting toward the rotary support 17. The maximum angle of inclination of the cam plate 18 is established where the maximum inclination setting part 32 comes into contact with the rear surface of the rotary support 17.

A plurality of cylinder bores 12*a* (of which only one is shown in the drawings) are formed in the cylinder block 12 at regular intervals around the axis L of the drive shaft 16, and single-ended pistons 23 are accommodated in the individual cylinder bores 12*a*. The pistons 23 are linked to an outer peripheral part of the cam plate 18 by shoes 24.

A suction chamber 25 is formed in a central part of the rear housing 13 while a discharge chamber 26 is formed in a peripheral part of the rear housing 13. Suction ports 27, suction valves 28, discharge ports 29 and discharge valves 30 are formed in the valve plate 14.

The cam plate 18 is made rotatable together with the drive shaft 16 by means of the rotary support 17 and the hinge mechanism 20. Oscillatory motion of the cam plate 18 in the direction of the axis L produced by rotary motion of the drive shaft 16 is converted into reciprocating motion of the individual pistons 23 by way of the shoes 24. When the point Da of the cam plate 18 corresponding to the top dead center matches a particular piston 23, the same piston 23 is at its top dead center as shown in FIGS. 2 and 3. When a point Db of the cam plate 18 corresponding to a bottom dead center matches the same piston 23 after the cam plate 18 has rotated 180 degrees from the position shown in FIGS. 2 and 3, the piston 23 reaches its bottom dead center.

Accordingly, a refrigerant gas in the suction chamber 25 is introduced into a particular cylinder bore 12*a* through its suction port 27 and suction valve 28 as the corresponding piston 23 moves from its top dead center to its bottom dead center. The refrigerant gas thus taken into the cylinder bore 12*a* is compressed and expelled into the discharge chamber 26 as the same piston 23 moves from its bottom dead center to its top dead center.

A gas release channel 35 interconnect the crankcase 15 and the suction chamber 25. A gas feeder channel 36 interconnect the discharge chamber 26 and the crankcase 15. There is provided a capacity control valve 37 in the gas feeder channel 36. A pressure-sensing channel 38 interconnect the suction chamber 25 and the capacity control valve 37. Preferably, the capacity control valve 37 is a pressure-sensing valve including a diaphragm 37*a* which responds to the pressure of the suction chamber 25 introduced through the pressure-sensing channel 38 and a valve element 37*b* which is movably connected to the diaphragm 37*a*.

In this construction, the opening of the gas feeder channel 36 is regulated by the capacity control valve 37 to alter the pressure in the crankcase 15, whereby the difference between the pressure in the crankcase 15 and the pressure in each cylinder bore 12*a* acting on front and rear ends of each piston 23 is adjusted. As a consequence, the angle of inclination of the cam plate 18 and the stroke of the pistons 23 are varied and the displacement capacity of the compressor is adjusted.

For example, if the load in cooling operation is light, suction pressure becomes lower than a set value and the capacity control valve 37 acts to increase the opening of the gas feeder channel 36. As a result, the refrigerant gas is introduced from the discharge chamber 26 into the crankcase 15, causing the pressure in the crankcase 15 to increase. Accordingly, the bulbous parts 21 a of the guide pins 21A and 21B of the hinge mechanism 20 slide in the guide holes 22A and 22B in the respective supporting arms 33 in such a way that the bulbous parts 2 a come closer to the axis L of the drive shaft 16. The cam plate 18 itself is caused to slide along, the drive shaft 16 toward the cylinder block 12 with the supporting part 19*a* held in contact with an outer cylindrical surface of the drive shaft 16 and to swing counterclockwise about the axis S of the supporting part 19*a*. The angle of inclination of the cam plate 18 is thus minimized as shown in FIG. 3 and the stroke of the pistons 23 are reduced. Consequently, the displacement capacity decreases and the suction pressure is caused to increase so that it approaches the set value.

Alternatively, if the load in cooling operation is heavy, the suction pressure becomes higher than the set value and the capacity control valve 37 acts to decrease the opening of the gas feeder channel 36. As a result, the pressure in the crankcase 15 is caused to decrease as the pressure is released into the suction chamber 25 through the gas release channel 35. Accordingly, the bulbous parts 21*a* of the guide pins 21A and 21B of the hinge mechanism 20 slide in the guide holes 22A and 22B in the respective supporting arms 33 in such a way that the bulbous parts 21*a* are separated from the axis L of the drive shaft 16. The cam plate 18 itself is caused to slide along the drive shaft 16 toward the rotary support 17 with the supporting part 19*a* held in contact with the outer cylindrical surface of the drive shaft 16 and to swing clockwise about the axis S of the supporting part 19*a*. The angle of inclination of the cam plate 18 is thus maximized as shown in FIG. 2 and the stroke of the pistons 23 are increased. Consequently, the displacement capacity increases and the suction pressure is caused to decrease so that it approaches the set value.

Characteristic features of the present embodiment are now described.

FIGS. 2 and 4 depict a state in which the cam plate 18 is set to its maximum angle of inclination. The aforementioned maximum inclination setting part 32 is preferably formed as an integral part of the cam plate 18 projecting from an inside circumferential area of the front surface of the cam plate 18 facing the rotary support 17. Preferably, the maximum inclination setting part 32 is U-shaped in front view and is formed so as if to surround the opening of the through hole 19 at the central part of the front surface of the cam plate 18. A front surface of the U-shaped structure 39 of the maximum inclination setting part 32 comes into contact with the rotary support 17. The rotary support 17 has on its rear side a flat contact surface 17*a* which allows the maximum inclination setting part 32 to come into contact.

Referring to FIG. 4, an imaginary two-part dividing plane H (shown by crosshatching) intersects an imaginary plane including the points Da and Db of the cam plate 18 corresponding to the top dead center and the bottom dead center, respectively, and the axis L of the drive shaft 16 at right angles along the axis L, imaginarily dividing the cam plate 18 into two parts. The maximum inclination setting part 32 extends from the bottom of its U-shaped structure 39 located closer to the point Db corresponding to the bottom dead center than the imaginary two-part dividing plane H toward the point Da corresponding to the top dead center, both upper ends of the U-shaped structure 39 reaching beyond the imaginary two-part dividing plane H.

Accordingly, the maximum inclination setting part 32 has a first contact part 32*a* which comes into contact with the rotary support 17 in a region closer to the point Db corresponding to the bottom dead center than the imaginary two-part dividing plane H, a second contact part 32*b* which comes into contact with the rotary support 17 ahead of the point Da corresponding to the top dead center with respect to the rotating direction of the drive shaft 16 in a region closer to the point Da than the imaginary two-part dividing plane H, and a third contact part 32*c* which comes into contact with the rotary support 17 behind the point Da corresponding to the top dead center with respect to the rotating direction of the drive shaft 16 in the region closer to the point Da than the imaginary twopart dividing plane H.

When the compressor is run with the cam plate 18 set to other than its maximum angle of inclination, the cam plate 18 is supported by an area of contact between the drive shaft 16 and the supporting part 19*a* of the through hole 19 as well as by areas of contact between the bulbous parts 21*a* of the individual guide pins 21A, 21B and inside surfaces of the guide holes 22A, 22B. Thus, a compressive load applied to the cam plate 18 by the pistons 23 is shared by these areas of contact.

Since the area of contact between the guide pin 21A and the guide hole 22A located ahead of the point Da with respect to the rotating direction of the drive shaft 16, or on a side of the cam plate 18 linked to the piston 23 in a compression stroke, is closer to the center of the compressive load, the area of contact between the guide pin 21A and the guide hole 22A would potentially shares a greater part of the compressive load than the area of contact between the other guide pin 21B and the guide hole 22B. Represented in a circle in FIG. 3 is an enlarged view depicting how the bulbous part 21*a* of the guide pin 21B comes in contact with half the cylindrical inside surface of the guide hole 22B closer to the rotary support 17 to sustain the compressive load.

Figure 10:
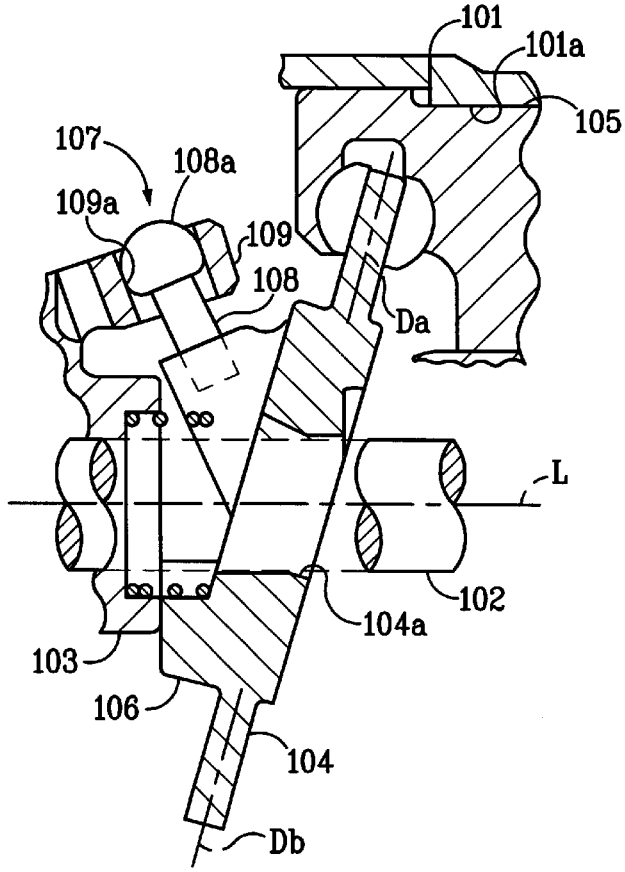
FIG. 10 Prior Art
FIG. 10 shows an arrangement used in a conventional variable displacement compressor.

The prior art technology illustrated in FIG. 10 is now described in further detail with reference to the first embodiment of the invention shown in FIG. 4 to permit a comparison between the conventional structure and the first embodiment of the invention.

The maximum inclination setting projection 106 of the prior art is brought into contact with the rotary support 103 in a region closer to the point Db corresponding to the bottom dead center than the aforementioned imaginary two-part dividing plane H. More specifically, the maximum inclination setting projection 106 has only one contact surface corresponding to the first contact part 32*a* of the maximum inclination setting part 32 of this embodiment.

When the cam plate 104 is in its maximum angle of inclination, it is supported by an area of contact between the maximum inclination setting projection 106 and the rotary support 103, an area of contact between the drive shaft 102 and the through hole 104*a*, and areas of contact between the bulbous parts 108*a* of the individual guide pins 108 and inside surfaces of the guide holes 109*a*.

Therefore, the area of contact between the maximum inclination setting, projection 106 and the rotary support 103 sustains the compressive load applied to the cam plate 104 in the region closer to the point Db corresponding to the bottom dead center than the aforementioned imaginary two-part dividing plane H. Also, the areas of contact between the bulbous parts 108*a* of the individual guide pins 108 and the inside surfaces of the guide holes 109*a* sustain the compressive load applied to the cam plate 104 in a region closer to the point Da corresponding to the top dead center than the imaginary two-part dividing plane H. In other words, the area of contact between the maximum inclination setting projection 106 and the rotary support 103 sustains the compressive load only in the region closer to the point Db corresponding to the bottom dead center than the imaginary two-part dividing plane H. Accordingly, whatever proportion of the compressive load is exerted on the region closer to the point Da corresponding to the top dead center than the imaginary two-part dividing plane H, it should have been sustained by the hinge mechanism 107 alone in the prior art.

The maximum inclination setting part 32 of the present embodiment, however, has the second contact part 32*b* and the third contact part 32*c* in addition to the first contact part 32*a*. In this construction, when the maximum inclination setting part 32 comes into contact with the rotary support 17, an area of contact between the first contact part 32*a* and the rotary support 17 supports the cam plate 18 in the region closer to the point Db corresponding to the bottom dead center than the imaginary two-part dividing plane H while areas of contact between the second and third contact parts 32*b*, 32*c* and the rotary support 17 support the cam plate 18 in the region closer to the point Da corresponding to the top dead center than the imaginary two-part dividing plane H. Thus, the hinge mechanism 20 is not required to support any proportion of the compressive load in the region closer to the point Da corresponding to the top dead center than the imaginary two-part dividing plane H when the cam plate 18 is in its maximum angle of inclination. This is because the cam plate 18 is supported by the areas of contact between the maximum inclination setting part 32 and the rotary support 17 and the area of contact between the drive shaft 16 and the supporting part 19*a* of the through hole 19 as mentioned above.

More specifically, the area of contact between the second contact part 32*b* and the rotary support 17 supports the cam plate 18 ahead of the point Da corresponding to the top dead center with respect to the rotating direction of the drive shaft 16 in the region closer to the point Da than the imaginary two-part dividing plane H. Since the area of contact between the second contact part 32*b* and the rotary support 17 located ahead of the point Da corresponding to the top dead center with respect to the rotating direction of the drive shaft 16 in the region closer to the point Da than the imaginary two-part dividing plane H supports the cam plate 18 in this manner when the cam plate 18 is in its maximum angle of inclination, the area of contact between the bulbous part 21*a* of the guide pin 21A and the guide hole 22A is not required to support any proportion of the compressive load.

Further, the area of contact between the third contact part 32*c* and the rotary support 17 supports the cam plate 18 behind the point Da corresponding to the top dead center with respect to the rotating direction of the drive shaft 16 in the region closer to the point Da than the imaginary two-part dividing plane H. Since the area of contact between the third contact part 32*c* and the rotary support 17 located behind the point Da corresponding to the top dead center with respect to the rotating direction of the drive shaft 16 in the region closer to the point Da than the imaginary two-part dividing plane H supports the cam plate 18 in this manner when the cam plate 18 is in its maximum angle of inclination, the area of contact between the bulbous part 21*a* of the guide pin 21B and the guide hole 22B is not required to support any proportion of the compressive load.

Figure 5:
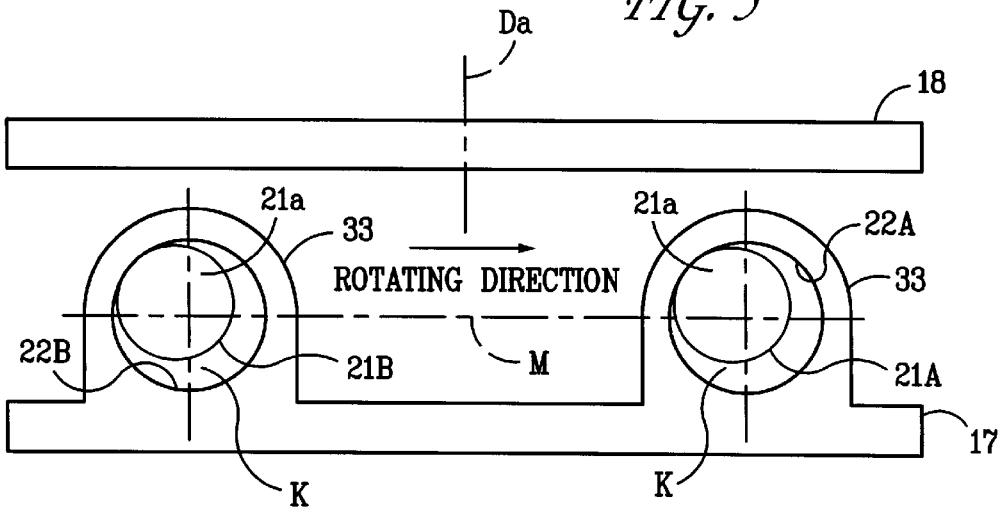
FIG. 5 is a diagram schematically showing a hinge mechanism.

The construction of this embodiment is such that the bulbous parts 21*a* of the individual guide pins 21A, 21B come in contact with the guide holes 22A, 22B as schematically shown in an enlarged view in FIG. 2 and FIG. 5 when the cam plate 18 is in its maximum angle of inclination. Specifically, the bulbous parts 21*a* of the guide pins 21A, 21B do not come in contact with halves of the cylindrical inside surfaces of the guide holes 22A, 22B closer to the rotary support 17 (or with portions closer to the rotary support 17 than a straight line M passing through the centers of the two guide holes 22A, 22B as depicted in FIG. 5), and there is made a clearance K between the bulbous part 21*a* of the guide pin 21A and the guide hole 22A and between the bulbous part 21*a* of the guide pin 21B and the guide hole 22B, interrupting transmission of the compressive load between them. Accordingly, the hinge mechanism 20 simply transmits a driving torque from the rotary support 17 to the cam plate 18 and does not work as a path for transmitting a maximum compressive load exerted on the cam plate 18 to the rotary support 17.

The first embodiment described hereinbefore provides the following advantageous effects:

(1) A pair of guide pins 21A, 21B are provided on both sides of the point Da of the cam plate 18 corresponding to the top dead center. The area of contact between the bulbous part 21*a* of the guide pin 21A and the guide hole 22A, which are closer to the piston 23 in a compression stroke, shares a greater proportion of the compressive load than the area of contact between the bulbous part 21*a* of the guide pin 21B and the guide hole 22B. However, when the cam plate 18 is in its maximum angle of inclination, there is formed the clearance K between the bulbous part 21*a* of the guide pin 21A and the guide hole 22A so that transmission of the compressive load between the guide pin 21A and the guide hole 22A is interrupted. It is therefore possible to significantly reduce the proportion of load to be supported by the hinge mechanism 20 to the maximum compressive load applied to the cam plate 18 when the compressor is run at its maximum displacement capacity.

(2) When the cam plate 18 is in its maximum angle of inclination, there is formed the clearance K between the bulbous part 21*a* of the guide pin 21B and the guide hole 22B so that transmission of the compressive load between them is interrupted. This also serves to reduce the proportion of load to be supported by the hinge mechanism 20 to the maximum compressive load applied to the cam plate 18 when the compressor is run at its maximum displacement capacity.

(3) For reasons stated in points (1) and (2) above, no compressive load is exerted on the hinge mechanism 20 when the cam plate 18 is in its maximum angle of inclination. Accordingly, it is not necessary to take into account a large reaction force to the maximum compressive load in designing the guide pins 21A and 21B and, as a consequence, it becomes possible to avoid an increase in the weight of the cam plate 18 unlike the earlier-described prior art technology. This makes it possible to swiftly alter the angle of inclination of the cam plate 18, enabling an improvement in the controllability of the displacement capacity of the compressor.

(4) Since no compressive load is exerted on the hinge mechanism 20 when the compressor is run at its maximum displacement capacity, the cam plate 18 is not required to provide so high a mechanical strength (length of press-fitting) for supporting the guide pins 21A and 21B. This makes it possible to employ an aluminum-based metallic material, which generally has a lower stiffness than iron-based metallic materials, for constructing the cam plate 18, allowing a further reduction in the weight of the cam plate 18.

(5) The cam plate 18 is supported and guided by the drive shaft 16 directly at the supporting part 19*a* in the through hole 19. Since it is not necessary to mount a sleeve on the drive shaft 16 in a manner that allows the sleeve to slide along the drive shaft 16 or pivot pins projecting from the sleeve to support the cam plate 18 in a manner that allows it to be inclined in this construction, it becomes possible to reduce the number of components. Accordingly, this construction serves to reduce manufacturing costs and facilitate component management.

SECOND EMBODIMENT

Figure 8A:
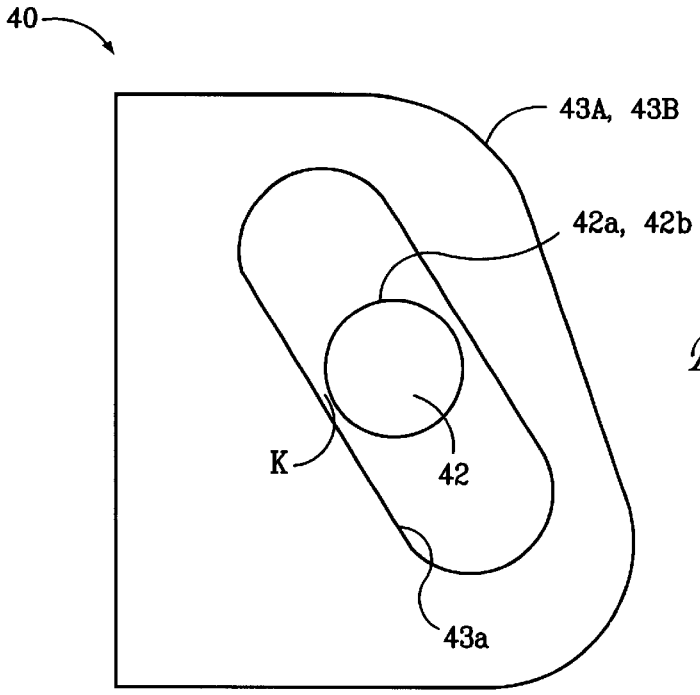
FIGS. 8(*a*) and 8(*b*) are diagrams schematically showing the hinge mechanism.
Figure 8B:
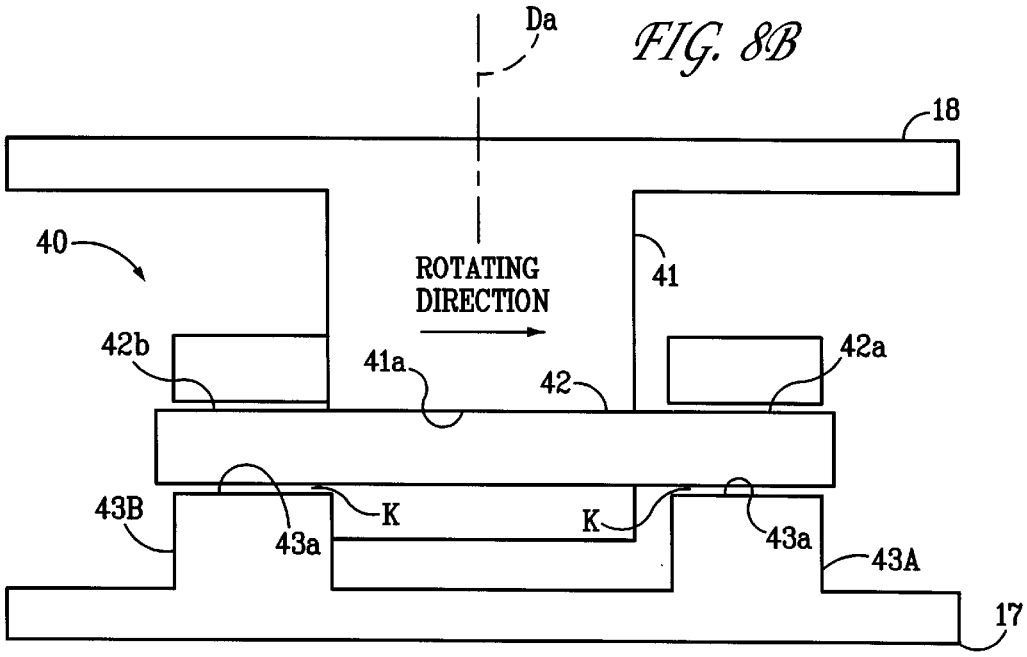

FIGS. 6 to 8 depict a second embodiment of the invention employing a hinge mechanism 40 whose construction is somewhat different from the hinge mechanism 20 of the first embodiment. Specifically, the hinge mechanism 40 includes a swing arm 41 projecting from a cam plate 18 at its point Da corresponding to a top dead center. The swing arm 41 extends toward a rotary support 17 and a fixing hole 41 a is formed in a far end portion of the swing arm 41 at right angles to an axis L of a drive shaft 16. A guide pin 42 is securely press-fitted in the fixing hole 41*a*. Both terminal portions 42*a*, 42*b* of the guide pin 42 which serve as guiding projections jut out from both sides of the swing arm 41 along the rotating direction of the drive shaft 16.

There are provided a pair of supporting arms 43A, 43B on the rotary support 17 projecting from an outer peripheral part of its rear surface on both sides of the point Da of the cam plate 18 corresponding to the top dead center, one ahead of and the other behind the point Da with respect to the rotating direction of the drive shaft 16. The aforementioned swing arm 41 lies just between the supporting arms 43A and 43B so that the supporting arms 43A and 43B are located ahead of and behind the swing arm 41 with respect to the rotating direction of the drive shaft 16.

A guide holes 43*a*, which serve as guides, are formed from inside surfaces of the individual supporting arms 43A, 43B to their outside surfaces in the form of cam grooves which are inclined toward the drive shaft 16 as they come closer to the cam plate 18. The terminal portions 42*a* and 42*b* of the guide pin 42 are fitted in the guide holes 43*a* formed in the supporting arms 43A and 43B, respectively.

A driving torque is transmitted from the rotary support 17 to the cam plate 18 chiefly as the supporting arm 43B located at the rear of the rotating direction of the drive shaft 16 comes in direct contact with a side surface of the swing arm 41. When the displacement capacity of the compressor is altered, the cam plate 18 is guided by camand-groove-like joints formed by the terminal portions 42*a*, 42*b* of the guide pin 42 and the guide holes 43*a*. When the compressor is run with the cam plate 18 set to other than its maximum angle of inclination, the hinge mechanism 40 receives a compressive load at areas of contact between the terminal portions 42*a*, 42*b* of the guide pin 42 and inside surfaces of the guide holes 43*a* formed in the supporting arms 43A, 43B.

The cam plate 18 of this embodiment is also provided with a maximum inclination setting part 32 like the one of the earlier-described first embodiment. Thus, the hinge mechanism 40 is not required to support any proportion of the compressive load in a region closer to the point Da corresponding to the top dead center than an imaginary two-part dividing plane H when the cam plate 18 is in its maximum angle of inclination.

In this embodiment, both terminal portions 42*a*, 42*b* of the guide pin 42 come in contact with the guide holes 43*a* in the supporting arms 43A, 43B as schematically shown in FIGS. 8(*a*) and 8(*b*) when the cam plate 18 is in its maximum angle of inclination. Specifically, the terminal portions 42*a*, 42*b* of the guide pin 42 do not come in contact with halves of the cylindrical inside surfaces of the guide holes 43*a* in the supporting arms 43A, 43B closer to the rotary support 17, and there is made a clearance K between the terminal portion 42*a* and its corresponding guide hole 43*a* and between the terminal portion 42*b* and its corresponding guide hole 43*a*. Accordingly, the hinge mechanism 40 simply transmits the driving torque from the rotary support 17 to the cam plate 18 and does not work as a path for transmitting a maximum compressive load exerted on the cam plate 18 to the rotary support 17. It is apparent from the above discussion that the present embodiment provides the same advantageous effects as the first embodiment.

While the invention has been described with reference to its preferred embodiments, the invention can be implemented in varied forms without departing from the true spirit and scope thereof. Some examples of such variations are described in the following.

Figure 9:
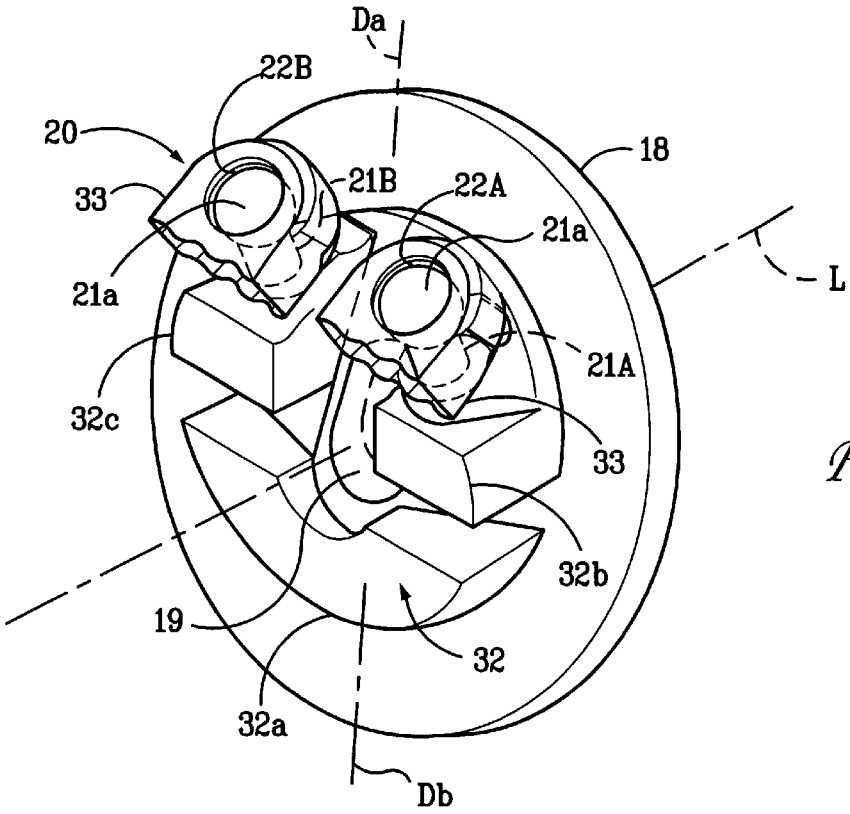
FIG. 9 is a perspective diagram showing a varied form of the invention.

FIG. 9 shows one variation of the invention, in which the first to third contact parts 32*a*–32*c* of the earlier-mentioned maximum inclination setting part 32 are formed as separate projecting parts. This construction makes it possible to eliminate a solid portion connecting the first contact part 32*a* and the second contact part 32*b* as well as another solid portion connecting the first contact part 32*a* and the third contact part 32*c* so that the weight of the cam plate 18 can be further reduced.

The maximum inclination setting part 32 is constructed such that it comes into contact with the rotary support 17 in the region closer to the point Da corresponding to the top dead center than the imaginary two-part dividing plane H as well as in the region closer to the o the bottom dead center than the imaginary two-part dividing plane H when the cam plate 18 is in its maximum angle of inclination in either of the aforementioned embodiments. The invention is not limited to this construction, however. In another variation of the invention, there may be provided a maximum inclination setting part 32 formed of only a second contact part 32*b* and a third contact part 32*c* so that the maximum inclination setting part 32 comes into contact with the rotary support 17 only in the region closer to the point Da corresponding to the top dead center than the imaginary two-part dividing plane H when the cam plate 18 is in its maximum angle of inclination.

In still another variation of the invention, the third contact part 32*c* of the aforementioned maximum inclination setting part 32 is eliminated leaving only the first contact part 32*a* and the second contact part 32*b*. In this variation, the area of contact between the bulbous part 21*a* of the guide pin 21B and the inside surface of the guide hole 22B supports a proportion of the compressive load behind the point Da corresponding to the top dead center with respect to the rotating direction of the drive shaft 16 in the region closer to the point Da than the imaginary two-part dividing plane H when the cam plate 18 is in its maximum angle of inclination.

In yet another variation of the invention, the second contact part 32*b* of the aforementioned maximum inclination setting part 32 is eliminated leaving only the first contact part 32*a* and the third contact part 32*c*. In this variation, the area of contact between the bulbous part 21*a* of the guide pin 21B and the inside surface of the guide hole 22A supports a proportion of the compressive load ahead of the point Da corresponding to the top dead center with respect to the rotating direction of the drive shaft 16 in the region closer to the point Da than the imaginary two-part dividing plane H when the cam plate 18 is in its maximum angle of inclination.

In a further variation of the invention, the cam plate 18 is formed of a material having a higher stiffness than the aluminum-based metallic material, such as an iron-based metallic material. This construction helps increase mechanical strength for supporting the guide pins 21A, 21B and thereby reduce the thickness of the cam plate 18 in its portions around the mounting holes 18*a* in which the guide pins 21A, 21B are fitted In a still further variation of the invention, the aforementioned maximum inclination setting part 32 is eliminated and, instead, a similar projecting part is formed on the rotary support 17. In addition, a maximum inclination setting flat surface is formed on the cam plate 18 to allow the projecting part of the rotary support 17 to come into contact with the cam plate 18.

The maximum inclination setting part 32 may be formed as a separate component from the cam plate 18. This variation makes it possible to construct the maximum inclination setting part 32 using a different material from the cam plate 18. If the maximum inclination setting part 32 is constructed of an iron-based metallic material, for example, in either of the aforementioned embodiments, the wear resistance performance of the maximum inclination setting part 32 is increased.

Furthermore, the invention may be embodied in a wobble-type variable displacement compressor.

What is claimed is:

1. A compressor comprising:

a housing;

a drive shaft rotatably supported by said housing;

a rotary support coupled to said drive shaft;

a cam plate disposed in said compressor housing, said cam plate having a through hole formed in its center;

a hinge mechanism disposed between and connectively engaging said rotary support and said cam plate; and a maximum inclination setting part disposed between said cam plate and said rotary support, said maximum inclination setting part constructed for spinning engagement with said rotary support and said cam plate, wherein said maximum inclination setting part forms a point of contact between the cam plate and the rotary support and interrupts the transmission of a compressive force to said hinge mechanism as said cam plate is at a maximum angle of inclination and wherein at least one portion of said maximum inclination setting part extends above a plane formed through a horizontal center of said cam plate.

2. The compressor of claim 1 wherein said maximum inclination setting part further comprises:

a first contact part which comes into contact with said rotary support in a region closer to a point Db corresponding to the bottom dead center than to an imaginary two-part dividing plane H through said horizontal center of said cam plate;

a second contact part which comes into contact with said rotary support ahead of a point Da corresponding to the top dead center with respect to the rotating direction of said drive shaft in a region closer to said point Da than to said imaginary two-part dividing plane H; and a third contact part which comes into contact with said rotary support behind said point Da corresponding to the top dead center with respect to the rotating direction of said drive shaft in the region closer to said point Da than to said imaginary two-part dividing plane H.

3. The compressor of claim 2 wherein said first contact part, said second contact part, and said third contact part are formed as separate projecting parts.

4. The compressor of claim 1 wherein said maximum inclination setting part comprises a U-shaped structure, wherein said U-shaped structure is formed on the central part of a front surface of said cam plate such that said U-shaped structure opens toward the top dead center of said cam plate, wherein a least a portion of the upper ends of said U-shaped structure extend above a plane through the horizontal center of said cam plate.

5. The compressor of claim 1 wherein said maximum inclination setting part is formed such that said cam plate is supported in a region closer to the point corresponding to the top dead center than to an imaginary two-part dividing plane at a location where said maximum inclination setting part comes into contact with said rotary support when said cam plate is in its maximum angle of inclination.

6. The compressor of claim 1 wherein said maximum inclination setting part is formed such that said cam plate is supported ahead of the point corresponding to the top dead center with respect to the rotating direction of said drive shaft at least in the region closer to a point corresponding to the top dead center than to an imaginary two-part dividing plane at a location where said maximum inclination setting part comes into contact with said rotary support when said cam plate is in its maximum angle of inclination.

7. The compressor of claim 1 wherein said maximum inclination setting part is formed such that said cam plate is supported behind the point corresponding to the top dead center with respect to the rotating direction of said drive shaft at least in the region closer to a point corresponding to the top dead center than to an imaginary two-part dividing plane at a location where said maximum inclination setting part comes into contact with said rotary support when said cam plate is in its maximum angle of inclination.

8. The compressor of claim 1 wherein said maximum inclination setting part is disposed on an inside circumferential area of a front surface of said cam plate facing said rotary support, and said rotary support has a flat contact surface on a rear side of said rotary support.

9. The compressor of claim 8 wherein said maximum inclination setting part is integral with said cam plate.

10. The compressor of claim 8 wherein said maximum inclination setting part is separate from and coupled to said cam plate.

11. The compressor of claim 1 wherein said maximum inclination setting part is disposed on an inside circumferential area of a rear surface of said rotary support facing said cam plate, and said cam plate has a flat contact surface on a front side of said cam plate.

12. The compressor of claim 1 wherein said hinge mechanism further comprises:

a guiding projection provided on one of said cam plate and said rotary support at a point corresponding to a top dead center of said cam plate; and a guide provided on one of said cam plate and said rotary support on which said guiding projection is not provided, said guiding projection being slidably fitted in said guide.

13. The compressor of claim 12 wherein said guiding projection further comprises:

a pair of guide pins projecting from one of said cam plate and said rotary support to serve as guiding projections; and a pair of bulbous parts disposed proximate an extreme end of said guide pins; and said guide further comprises:

a pair of supporting arms projecting from one of said cam plate and said rotary support on which said guide pins are not provided;

a pair of guide holes which allow said bulbous parts of said guide pins to be slidably fitted to serve as guides; and wherein a clearance is formed between said bulbous part and said guide hole as said cam plate approaches a maximum angle of inclination.

14. The compressor of claim 13 wherein said clearance is formed proximate a front side of said guide hole.

15. The compressor of claim 13 wherein said maximum inclination setting part is positioned on said cam plate such that said maximum inclination setting part interrupts the transmission of a compressive force between said guide hole and said guide pin bulbous part when said cam plate approaches a maximum angle of inclination.

16. The compressor of claim 1 wherein said hinge mechanism further comprises:

a swing arm projecting from one of said cam plate and said rotary support;

a pair of supporting arms projecting from one of said cam plate and said rotary support on which said swing arm is not provided, one of said supporting arms being located ahead of, and said other supporting arm being located behind said swing arm with respect to the rotating direction of said drive shaft;

a pair of guiding projections jutting out toward the respective supporting arms; and guide holes, which serve as guides for the guiding projections which are fitted in said guide holes, said guide holes being formed in said supporting arms.

17. The compressor of claim 16 wherein said guide holes further comprise cam grooves formed in said supporting arms.

18. The compressor of claim 1 wherein said cam plate is formed of an aluminum-based metallic material.

19. The compressor of claim 1 wherein said cam plate is formed of an iron-based metallic material.

20. The compressor of claim 1 wherein said compressor is a variable displacement type compressor.

21. The compressor of claim 20 wherein said compressor is a swash plate type compressor.

22. A variable displacement compressor comprising:

a compressor housing;

a drive shaft disposed in said housing;

a rotary support coupled to said drive shaft, said rotary support having a flat contact surface disposed proximate a rear side of said rotary support;

a cam plate disposed in said compressor housing;

a hinge mechanism disposed between and connectively engaging said rotary support and said cam plate, said hinge mechanism further comprising one pair each of a guide pin, a bulbous part, and a guide hole, wherein said bulbous part is disposed proximate a second end of said guide pin, and said bulbous part is disposed in sliding contact with said guide hole, and wherein a clearance is formed between said bulbous part and said guide hole as said cam plate approaches a maximum angle of inclination; and at least one maximum inclination setting part formed on an inside circumferential area of a front surface of said cam plate facing said rotary support, wherein at least a portion of said maximum inclination setting part is formed above a plane through the horizontal center of said cam plate, and said maximum inclination setting part being adapted for spinning engagement with said rotary support, wherein said maximum inclination setting part interrupts the transmission of a compressive force to said hinge mechanism as said cam plate approaches a maximum angle of inclination.

23. The compressor of claim 22 wherein said clearance is proximate a front side of said guide hole.

24. The compressor of claim 22 wherein said at least one maximum inclination setting parts comprises a U-shaped structure, wherein said U-shaped structure is formed on said cam plate such that it opens toward the top dead center of said cam plate.

25. The compressor of claim 22 wherein said cam plate is made from aluminum.

26. The compressor of claim 22 wherein said maximum inclination setting part is positioned on said cam plate such that said maximum inclination setting part interrupts the transmission of a compressive force between said guide hole and said guide pin bulbous part when said cam plate approaches a maximum angle of inclination.

27. A variable displacement compressor comprising:

a housing having a front end, a rear end, a front housing, a cylinder block coupled to a rear end of said front housing, and a rear housing coupled to a rear end of said cylinder block;

a cylinder bore formed in said cylinder block of said housing;

a piston disposed in said cylinder bore;

a crankcase formed in said housing;

a drive shaft rotatably supported between said front housing block and said cylinder block of said housing;

a rotary support coupled to said drive shaft, said rotary support having a flat contact surface disposed proximate a rear side of said rotary support;

a cam plate positioned in said crankcase, said cam plate being slidably supported by said rotary drive shaft, said cam plate being capable of sliding along said drive shaft and inclining in an axial direction of said drive shaft, wherein the displacement capacity of said compressor is varied by controlling an angle of inclination of said cam plate in accordance with the difference between an internal pressure of said crankcase and a suction pressure present on both sides of said piston;

a shoe disposed between and slidably connecting said cam plate and said piston, wherein a rotational motion of said cam plate is converted into a reciprocating motion of said piston;

a hinge mechanism disposed between and connectively engaging said rotary support and said cam plate; and a maximum inclination setting part formed between said cam plate and said rotary support, said maximum inclination setting part adapted for spinning engagement with said rotary support and said cam plate, wherein said maximum inclination setting part interrupts the transmission of a compressive force to said hinge mechanism as said cam plate is at a maximum angle of inclination and wherein at least one portion of said maximum inclination setting part extends above an imaginary plane through a horizontal center of said cam plate.

28. A method of improving the controllability of a variable displacement compressor, said method comprising the steps of:

providing a compressor housing;

disposing a rotatable drive shaft in said housing;

coupling a rotary support to said drive shaft, said rotary support having a flat contact surface disposed proximate a rear side of said rotary support;

disposing a cam plate in said compressor housing;

connectively engaging a hinge mechanism between and said rotary support and said cam plate;

forming a maximum inclination setting part on a front of said cam plate, wherein at least a portion of said maximum inclination setting part extends above a horizontal plane through the center of said cam plate; and transferring the compressive force experienced near a maximum angle of inclination of said cam plate via said maximum inclination setting part from said hinge mechanism to said rotary support.

29. The method of claim 28 comprising the further step of reducing the weight of said cam plate by forming said cam plate of an aluminum-based metallic material.

30. A compressor comprising:

a housing;

a drive shaft rotatably supported by said housing;

a rotary support coupled to said drive shaft;

a cam plate disposed in said compressor housing, said cam plate having a through hole formed in its center;

a hinge mechanism disposed between and connectively engaging said rotary support and said cam plate, wherein said hinge mechanism comprises a pair of guide pins and guide holes, wherein a clearance is positively formed between said guide pin and said guide hole when said cam plate is at a maximum angle of inclination; and a maximum inclination setting part disposed between said cam plate and said rotary support, said maximum inclination setting part constricted for spinning engagement with said rotary support and said cam plate, wherein said maximum inclination setting part forms a point of contact between the cam plate and the rotary support to interrupt the transmission of a compressive force to said hinge mechanism as said cam plate is at a maximum angle of inclination.

31. A compressor comprising:

a housing;

a drive shaft rotatably supported by said housing;

a rotary support coupled to said drive shaft;

a cam plate disposed in said compressor housing, said cam plate having a through hole formed in its center;

a hinge mechanism disposed between and connectively engaging said rotary support and said cam plate; and a maximum inclination setting part disposed between said cam plate and said rotary support, said maximum inclination setting part constricted for spinning engagement with said rotary support and said cam plate, wherein said maximum inclination setting part forms a point of contact between the cam plate and the rotary support and interrupts the transmission of a compressive force to said hinge mechanism as said cam plate is at a maximum angle of inclination, wherein said maximum inclination setting part further comprises:

a first contact part which comes into contact with said rotary support in a region closer to a point Db corresponding to the bottom dead center than to an imaginary two-part dividing plane H through said horizontal center of said cam plate;

a second contact part which comes into contact with said rotary support ahead of a point Da corresponding to the top dead center with respect to the rotating direction of said drive shaft in a region closer to said point Da than to said imaginary two-part dividing plane H; and a third contact part which comes into contact with said rotary support behind said point Da corresponding to the top dead center with respect to the rotating direction of said drive shaft in the region closer to said point Da than to said imaginary two-part dividing plane H.

32. A compressor comprising:

a housing;

a drive shaft rotatably supported by said housing;

a rotary support coupled to said drive shaft;

a cam plate disposed in said compressor housing, said cam plate having a through hole formed in its center;

a hinge mechanism disposed between and connectively engaging said rotary support and said cam plate, wherein said hinge mechanism further comprises:

a guiding projection provided on one of said cam plate and said rotary support at a point corresponding to a top dead center of said cam plate, wherein said guiding projection further comprises:

a pair of guide pins projecting from one of said cam plate and said rotary support to serve as guiding projections;

a pair of bulbous parts disposed proximate an extreme end of said guide pins; and a guide provided on one of said cam plate and said rotary support on which said guiding projection is not provided, said guiding projection being slidably fitted in said guide, wherein said guide further comprises:

a pair of supporting arms projecting from one of said cam plate and said rotary support on which said guide pins are not provided;

a pair of guide holes which allow said bulbous parts of said guide pins to be slidably fitted to serve as guides;

wherein a clearance is formed between said bulbous part and said guide hole as said cam plate approaches a maximum angle of inclination, wherein said clearance is formed proximate a front side of said guide hole; and a maximum inclination setting part disposed between said cam plate and said rotary support, said maximum inclination setting part constructed for spinning engagement with said rotary support and said cam plate, wherein said maximum inclination setting part is positioned on said cam plate such that said maximum inclination setting part interrupts the transmission of a compressive force between said guide hole and said guide pin bulbous part when said cam plate approaches a maximum angle of inclination.

* * * * *

UNITED STATES PATENT AND TRADEMARK OFFICE

CERTIFICATE OF CORRECTION

PATENT NO. : 6,276,904 B1
DATED : August 21, 2001
INVENTOR(S) : Ota et al.

It is certified that error appears in the above-identified patent and that said Letters Patent is hereby corrected as shown below:

Column 6,
Line 5, delete "21 a" and insert therefor -- 21*a* --.

Column 7,
Line 20, delete "21 a" and insert therefor -- 21*a* --.
Line 23, delete "2 a" and insert therefor -- 21*a* --.
Line 25, after "along" delete ",".

Column 11,
Line 36, delete "41 a" and insert therefor -- 41*a* --.

Column 12,
Line 51, delete "o" and insert therefor -- point Db corresponding to --.

Column 14,
Line 30, delete "wherein a least a portion" and insert therefor -- wherein at least a portion --.

Column 18,
Line 11, delete "constricted" and insert therefor -- constructed --.

Signed and Sealed this

Twenty-eighth Day of May, 2002

*Attest:*

*Attesting Officer*

JAMES E. ROGAN
*Director of the United States Patent and Trademark Office*